United States Patent [19]

Saunders

[11] 4,414,836

[45] Nov. 15, 1983

[54] METHOD OF AND APPARATUS FOR DEEP DRAWING METAL CONTAINERS

[75] Inventor: William T. Saunders, Weirton, W. Va.

[73] Assignee: National Steel Corporation, Pittsburgh, Pa.

[21] Appl. No.: 430,957

[22] Filed: Sep. 30, 1982

[51] Int. Cl.[3] ..... B21D 22/00

[52] U.S. Cl. ..... 72/349; 72/348; 72/350

[58] Field of Search ..... 72/347, 348, 349, 350, 72/351

[56] References Cited

U.S. PATENT DOCUMENTS

| | | | |
|---|---|---|---|
| 2,289,199 | 7/1942 | Kloche | 72/349 |
| 2,312,749 | 3/1943 | Bullock . | |
| 3,490,265 | 1/1970 | Marcovitch . | |
| 3,494,169 | 2/1970 | Saunders . | |
| 3,664,172 | 5/1972 | Cvacho | 72/350 |
| 3,760,751 | 9/1973 | Dunn | 72/342 |
| 3,789,649 | 2/1974 | Clowes | 72/350 |
| 3,817,076 | 6/1974 | Wallace | 72/351 |
| 4,036,056 | 7/1977 | Saunders | 72/329 |
| 4,051,707 | 10/1977 | Valek et al. | 72/348 |
| 4,195,510 | 4/1980 | Juergens | 72/350 |
| 4,263,800 | 4/1981 | Arfert | 72/349 |

*Primary Examiner*—Leon Gilden

*Attorney, Agent, or Firm*—O'Neil and Bean

[57] ABSTRACT

An improved method and apparatus for deep drawing metal containers is disclosed in which flat sheet metal blanks are initially drawn into shallow cups having an open top, a substantially flat bottom wall, a substantially cylindrical sidewall and a curved transition section joining the bottom wall and sidewall. A redraw sleeve adapted to fit into and support the cups has a first annular clamping surface on its free end contoured and arranged to engage the transition section and the adjacent annular peripheral portion of the bottom wall of a cup. An annular redraw die is supported for movement from a retracted position spaced from the redraw sleeve to a clamping position cooperating with the redraw sleeve to clamp and hold the cups during redrawing. The redraw die has a second clamping surface contoured to engage the outer surface of the transition section and the adjacent annular peripheral portion of the bottom wall of a cup supported on the redraw sleeve. One of the clamping surfaces is defined by an annular clamping surface portion on an outer and at least one inner concentric ring member, with the clamping surface portion on the outer ring member being adapted to engage and clamp the transition section. A male die engages the bottom wall of a cup clamped between the redraw sleeve and redraw die to redraw the clamped cup. The annular ring members each apply a clamping load to a cup, and preferably, the load applied by the outer ring member is transferred to the inner ring member as the cup is drawn inwardly past the outer ring member.

28 Claims, 13 Drawing Figures

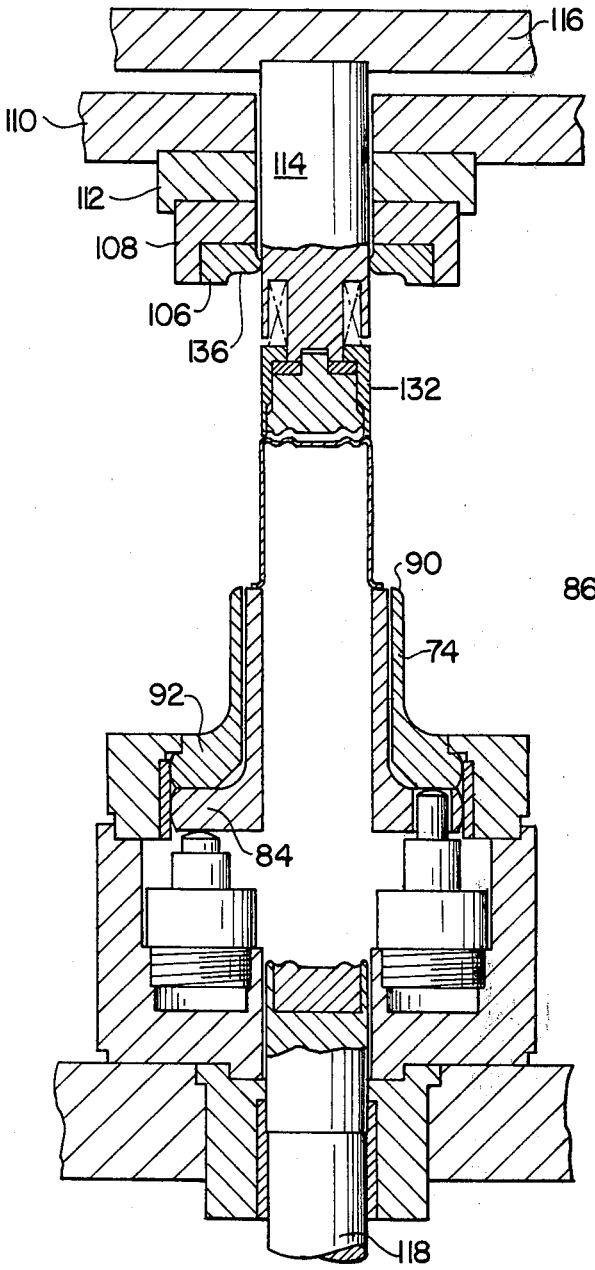
FIG. 7
FIG. 8
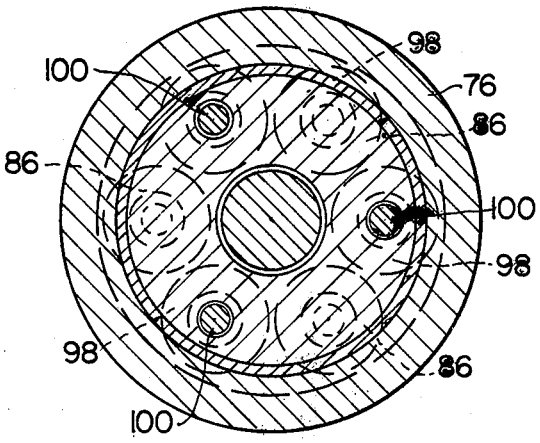
FIG. 9 (PRIOR ART)
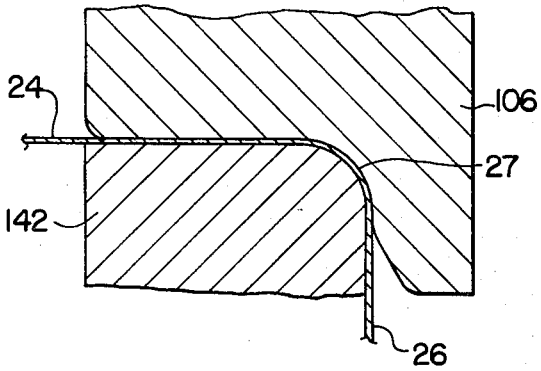
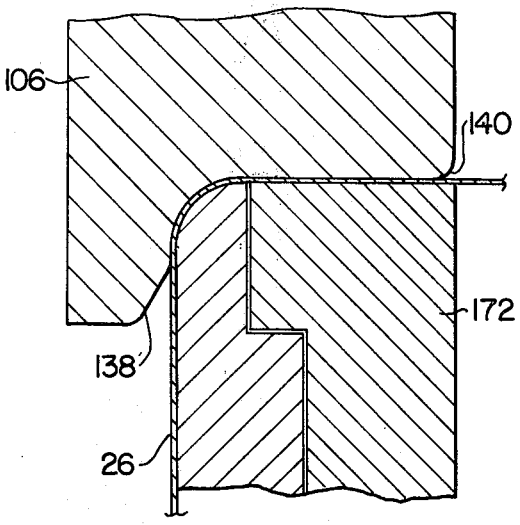
FIG. 10

METHOD OF AND APPARATUS FOR DEEP DRAWING METAL CONTAINERS

BACKGROUND OF THE INVENTION

1. Field of the Invention

This invention relates to a method of and apparatus for deep drawing metal articles and more particularly to such method and apparatus which reduces the tendency of metal to wrinkle or buckle in the redraw step of a draw and redraw can forming operation.

2. Description of the Prior Art

Deep drawing of can bodies from flat sheet metal, and particularly from sheet steel such as tinplate, has presented problems due to the tendency of the sheet material to buckle or form wrinkles during the drawing process. Such wrinkles may result in unsightly lines or structural defects in the sidewall of the finished can or in metal failure during the drawing operation.

In deep drawing sheet metal into a cylindrical configuration, the peripheral portion of a flat circular blank is clamped between opposed, general planar holding surfaces, and the central portion is pushed through an opening in a die by use of a cylindrical punch. As the punch telescopes through the die, the clamped peripheral portion of the blank is drawn radially inward and placed under very high compressive stresses in the circumferential direction while simultaneously being subjected to substantial tensile loads in the radial direction. The high compressive stresses increase progressively outward of the blank, with the result that there is a tendency for the thickness of the blank to be increased at its peripheral edge portion and thereby separate slightly the clamping surfaces. If the peripheral edge portion is permitted to thicken, the compressive stresses tend to buckle or form wrinkles in the radially inner portion adjacent the inner periphery of the die. These wrinkles not only produce an uneven appearance in the formed sidewall of the drawn container, but also produce stress concentration which can result in tearing of the metal under the heavy tensile loads.

In a shallow drawing operation, the stresses encountered will not exceed the strength of the metal being drawn; however, for deeper drawing operations, particularly when using steel rather than a softer metal such as aluminum, it has generally been necessary to use several drawing steps each producing a cup of progressively smaller diameter without exceeding the stress limits of the material being formed. It has generally been considered essential that all redrawing steps, i.e. drawing steps subsequent to the initial cupping step, progressively reduce the diameter of the cup in relatively small increments. This has been particularly true in deep drawing high strength steel materials where very high stresses are required. However, it is desirable to employ the minimum number of drawing steps both from the standpoint of reducing time and expense of the drawing operation and to reduce the adverse effects on the base material and on any metallic, chemical or organic coatings on such base material.

My prior U.S. Pat. No. 3,494,169 discloses a method of and apparatus for single stroke blanking and deep drawing of flat container sheet metal stock while maintaining a more uniform clamping load during the drawing operation. This is accomplished by utilizing a plurality of independently loaded concentric clamping rings which sequentially contact the flat circular blank of sheet metal to maintain a substantially uniform clamping force on the metal blank. The concentric clamping rings are arranged so that the largest diameter ring contacts the outer peripheral portion of the blank initially, with subsequent clamping rings engaging the blank as its diameter is progressively reduced. As the blank passes from beneath a clamping ring, that ring engages the opposed clamping surface of the movable annular die, thereby continuing to resist the drawing load applied to the blank. Each annular clamping ring applies its load, from a separate biasing means, independently of the load applied by other clamping rings.

U.S. Pat. No. 4,195,510 to Jurgens discloses an apparatus for drawing articles from flat sheet material including a clamping die plate including a draw die bead having alternate ridges and grooves in the clamping area adapted to permit slight thickening of the metal blank. In one embodiment the draw bead is formed in a plurality of parallel section each supported by a resilient pad to permit relative movement in a direction parallel to the drawing direction.

While the prior art method and apparatus disclosed in the above-mentioned patents have been effective, at least to some extend, in increasing the permissible depth of draw in the initial drawing operation from a flat blank, a one-step drawing operation generally cannot be employed in a high-speed can drawing operation to deep draw can bodies of the type employed, for example, as food and beverage containers. Accordingly, it is the primariy object of the present invention to provide an improved method of and apparatus for deep drawing of can bodies from flat sheet metal.

It is another object of the invention to provide an improved method of and apparatus for fomring a deep drawn can body requiring only a single redrawing step.

Another object of the invention is to provide an improved method of and apparatus for deep drawing can bodies in which flat circular blanks are initially drawn into shallow cups in a first drawing operation and in which the drawn cups are transferred to a second drawing station for redrawing on a draw press including a pair of concentric clamping rings adapted to cooperate to provide a more uniform clamping pressure during the redrawing operation.

Another object of the invention is to provide an improved method of and apparatus for redrawing a shallow cylindrical cup into a deep can body having a more uniform wall thickness and improved sidewall appearance.

SUMMARY OF THE INVENTION

The foregoing and other objects and advantages are achieved in accordance with the present invention wherein a flat circular metal blank is drawn into a shallow metal cup having a flat bottom wall, a substantially cylindrical sidewall, and a generally arcuate transition section joining the bottom wall and sidewall. The drawn cut is then transferred to a redraw apparatus where it is telescope onto and supported by a male redraw sleeve which cooperates with an annular redraw die for clamping the outer peripheral area of the bottom wall and at least the adjacent portion of the transition sections, and redrawn through the annular redraw die by a male redraw punch or mandrel. Either the redraw die or the redraw support sleeve comprises a pair of concentric ring elements each having a clamping surface contoured to engage an annular ring segment of the cup during the redrawing operation. The outer ring segment engages the transition portion of the cup, with the clamping surface on this outer ring segment having a clamping surface which is substantially arcuate in longitudinal section.

Each clamping ring element is independently resiliently biased in a direction to apply clamping pressure during the drawing operation. The clamping rings and male punch are arranged such that the clamping surfaces of both clamping rings are engaged with the cup prior to commencing the redrawing operation. The outer clamping ring engages and clamps the transition portion substantially simultaneously with or prior to engagement of the inner clamping ring with the bottom wall of the cup. The relative radial thickness of the inner and outer clamping ring portions are such that the center of radius of the curved clamping surface of the outer clamping ring lies on or is slightly inward of the parting line between the two clamping ring elements.

BRIEF DESCRIPTION OF THE DRAWINGS

Other objects and advantages of the invention will be apparent from the detailed description contained hereinbelow, taken in conjunction with the drawings, in which:

FIG. 7 is a view similar to FIGS. 5 and 6 and showing the redrawing apparatus upon completion of the redrawing cycle;

FIG. 8 is an enlarged sectional view taken on line 8—8 of FIG. 6;

FIG. 9 is an enlarged, fragmentary sectional view showing the clamping means employed by the prior art redrawing apparatus;

FIGS. 10–12 are view similar to FIG. 9 showing an alternate embodiment of the invention with certain elements shown in different positions in the respective views.

DESCRIPTION OF THE PREFERRED EMBODIMENTS

Figure 1:
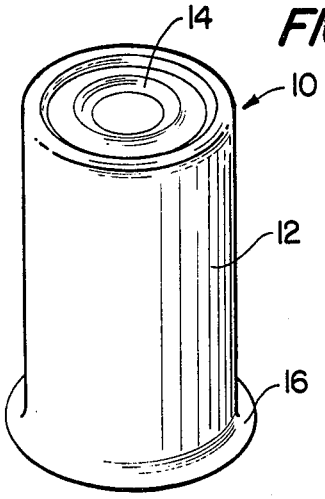
FIG. 1 is an isometric view of a deep drawn can body formed in accordance with the present invention.
Figure 2:
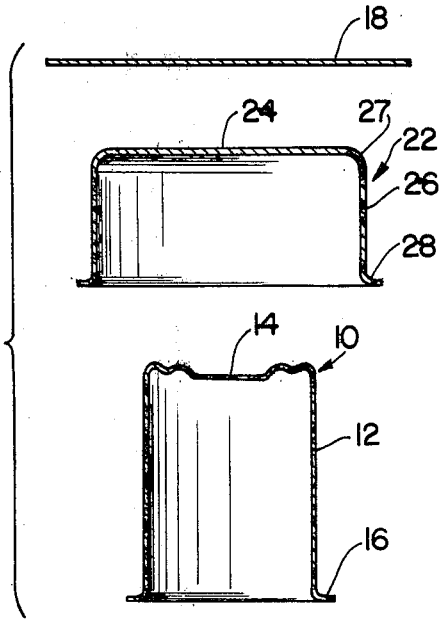
FIG. 2 is an exploded view showing three stages in the forming of the can body shown in FIG. 1.

Referring now to the drawings in detail, a deep drawn can body produced in accordance with the present invention is shown in FIGS. 1 and 2 and designated generally by the reference numeral 10. Can body 10 includes a cylindrical sidewall 12, a contoured bottom wall 14 with a narrow radially extending flange 16 at its open end. The deep drawn can body is formed from a circular blank 18 die cut from a flat sheet 20 and initially formed into a shallow cup having a flat bottom 24, cylindrical sidewall 26 and a narrow flange 28 formed around its open end. Bottom wall 24 and sidewall 26 are joined by a rounded transition section 27. As shown in FIG. 2, cup 22 has a diameter substantially greater and a sidewall height substantially less than that of the finished deep drawn can body 10.

Figure 3:
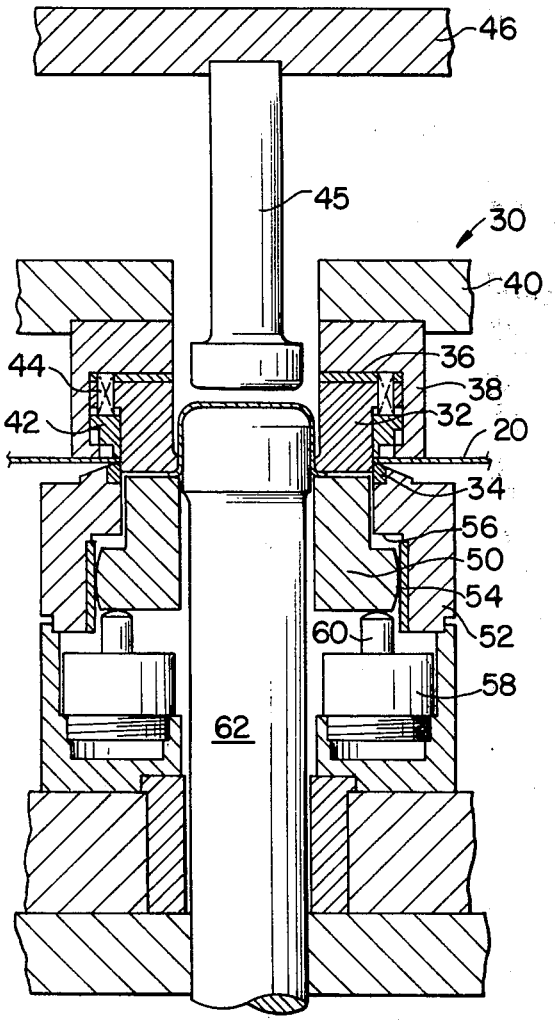
FIG. 3 is a schematic view, partially in section, of a known drawing press used for cutting a circular blank from a sheet of metal and drawing the blank into a shallow cup.
Figure 4:
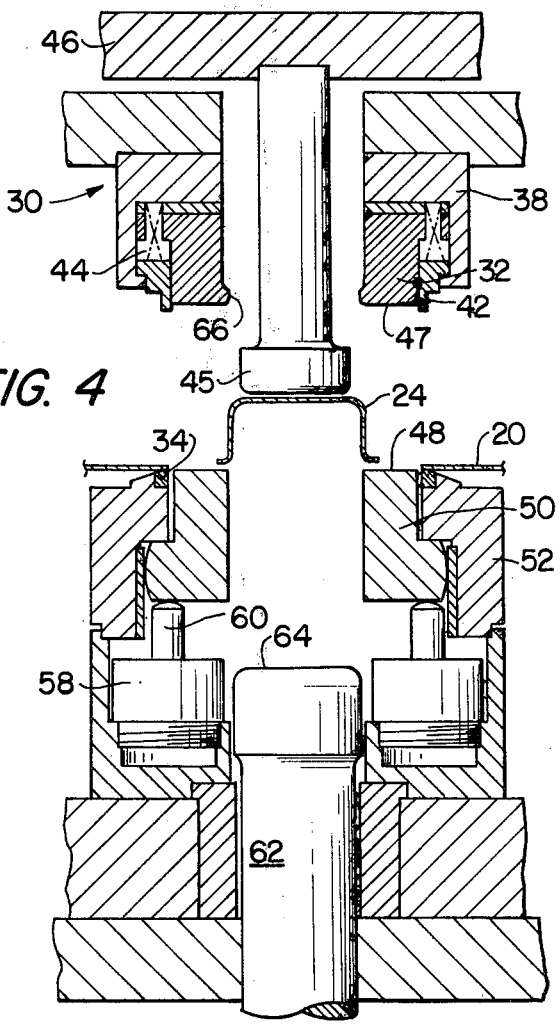
FIG. 4 is a view similar to FIG. 3 showing the apparatus immediately following the drawing operation.

Cup 22 is formed on the cupping, or drawing apparatus 30 schematically illustrated in FIGS. 2 and 4. Cupping apparatus 30 includes a vertically movable drawing die assembly including an annular draw punch 32 having an outer diameter corresponding to the diameter of steel blank 18. The bottom peripheral edge of draw punch 32 cooperates with a fixed annular cutting die 34 to sever the blank 18 from the flat sheet 20 upon vertical downward movement of the draw punch. A resilient pad 36 positioned on the top surface of draw punch 32 permits limited resilient resisted movement between the draw punch and mounting ring 38 which, in turn, is rigidly supported on vertically movable plate 40. A stripping ring 42 is slidably mounted on the outer surface of draw punch 32 and is resiliently biased downward by spring means 44 to strip plate 20 from drill punch 32 upon retraction, or vertically upward movement of the draw punch. A stationary knockout 45 is supported on fixed frame member 46 and projects downwardly into the open center portion of the movable draw punch in position to remove a drawn cup 22 from the draw punch after the cup has been formed and upon vertical movement of the draw punch from the position shown in FIG. 3 to that shown in FIG. 4. FIG. 4 also shows the stripping ring 42 projecting below the bottom horizontal clamping surface 46 of draw punch 32 which is its normal position when not in engagement with the flat sheet 20.

The bottom, substantially planar surface 47 of draw punch 32 engages and clamps the peripheral edge portion of flat blank 18 against the opposed, parallel clamping surface 48 of an annular clamping ring 50 mounted for limited vertical movement in a fixed guide ring 52 supported directly below and in axial alignment with draw punch 32. A radially extending flange 54 on guide ring 52 is normally urged upwardly into engagement with a downwardly directed radial shoulder 56 on guide ring 52 to limit vertical upward movement of the clamping ring 50. A plurality of fluid cylinders 58, typically nitrogen gas pressure actuated cylinders, have their pistons 60 engaging and normally urging clamping ring 50 upward to engage flange 54 with shoulder 56 at which position clamping surface 48 is in substantially coplanar relation with the cutting edge of cutting die 34.

With the drawing apparatus in the position shown in FIG. 4, sheet 20 can be advanced to extend over the cutting die 34 and clamping ring 50. Lowering the draw punch from the position shown in FIG. 4 to that shown in FIG. 3 then results in the circular blank 18 being substantially simultaneously severed and clamped between clamping surfaces 47 and 48. Further downward movement of draw punch 32 results in depression of pistons 60 against the fluid pressure in cylinders 58 and separation of flange 54 from shoulder 56 so that clamping pressure is maintained by the fluid in cylinders 58.

A cylindrical mandrel, or die center punch 62 is supported for vertical reciprocal movement from the retracted position shown in FIG. 4 to the extended position projecting upwardly through draw ring 50 and into the open center of draw punch 32 shown in FIG. 3. The distal end portion 64 mandrel 62 is contoured to the configuration of the interior of cup 22 and, upon movement to the extended position, engages the central portion of circular die blank 18 and draws the blank from between the parallel horizontal clamping surfaces 47, 48 to shape the blank into the cup 22. During this drawing operation, the clamping force between surfaces 47 and 48 restrains the blank with sufficient force to prevent wrinkling while permitting the metal to be drawn radially inward and shaped around draw surface 66 of punch 32 and the contoured end 64 of mandrel 62.

Vertical movement of mandrel 62 preferably terminates prior to the peripheral edge portion of blank 18 being completely withdrawn from between the clamping surface, thereby leaving the narrow flange 28 on the formed cup 22. As mandrel 62 is withdrawn to the retracted position the flange remains in contact with clamping surface 48 and strips the cup from the mandrel. Simultaneously, the draw punch 32 moves upward past the stationary knockout 45 to positively strip the drawn cup from the draw punch. The cup is then transferred, by suitable means not shown, to the next drawing station for redrawing into the deep drawn can body 10.

Referring now to FIGS. 5–8, apparatus for redrawing the shallow drawn cup 22 into the deep drawn can 10 is designated generally by the reference numeral 70 and is similar in operation and construction to the drawing apparatus 30 with certain modifications which will be described in detail below. Thus, redraw apparatus 70 includes a cup supporting and clamping assembly for receiving and supporting the drawn cup 22 in inverted, telescoping relation on concentric inner and outer redraw sleeve members 72, 74, each supported for limited vertical movement in a fixed guide ring 76 which, in turn, is rigidly mounted on an actuator cylinder support housing 78 mounted on fixed frame member 80. Inner redraw sleeve 72 terminates at its upper end in a substantially flat clamping surface 82 and at its lower end in a radially extending flange 84. A first plurality of fluid cylinders 86 mounted within housing 78 have pistons 88 which project upwardly and bear against the bottom surface of flange 84 to continuously urge redraw sleeve 72 upward.

Outer redraw sleeve 74 terminates at its top end in a substantially arcuate clamping surface 90 contoured to engage the inner surface of transition portion 27 of cup 22. An integrally formed radially extending flange 92 on the bottom of sleeve 74 has its bottom surface resting on and supported by the top surface of flange 84 and has an upwardly directed shoulder 94 (see FIG. 5) adapted to engage a downwardly directed shoulder 96 on guide ring 76 limits upward movement of the two redraw sleeves. A second plurality of fluid cylinders 98 have their pistons 100 extending through openings 102 in flange 84 and bearing against the downwardly directed surface of flange 92 to normally urge the outer redraw sleeve 74 upward. As shown in FIG. 8, there are three each of fluid cylinders 86 and 98 alternately arranged in a concentric circle within the cylindrical housing 78 to apply uniform pressure to the redraw sleeves 72 and 74.

The pistons 100 of cylinders 98 are each formed with a radially extending shoulder 104 which is spaced from the distal end of the piston by a distance which is greater than the thickness of flange 84 but slightly less than the combined thickness of the flange 84 and metal sheet 20. Thus, as pointed out more clearly hereinbelow, as the cup 22 is redrawn to the extent that the metal in the cup passes radially inward past the arcuate clamping surface 90 of outer redraw sleeve 74, this redraw sleeve will be projected upwardly until shoulder 104 also bears on the bottom surface of flange 84 and the full load of each of the six cylinders will then be applied directly to the inner redraw sleeve flange 84.

An annular redraw die 106 mounted in a die holder 108 is supported for vertical reciprocal movement above the redraw sleeves 72, 74 by vertically movable actuator plate 110 and mounting plate 112. A fixed knockout punch 114 is supported on rigid frame member 116 in position to be telescoped through the open center of die member 106 upon vertical movement of the die to its uppermost position as shown in FIG. 7. A vertically movable cylindrical die or mandrel 118 extends vertically through a bearing guide 120 in frame 80 and projects upwardly into the open center of inner die sleeve 72 and is reciprocated between an extended position shown in FIG. 6 and a retracted position shown in FIG. 7 by a vertically movable actuator plate 124.

A panel die member 126 is supported in a recess in the top end of mandrel 118 and has its top surface contoured to cooperate with a complementary panel die member 128 supported on the downwardly directed end of stationary knockout 114. A resilient pad 130 permits limited movement of die member 128 with respect to knockout 114 to thereby accommodate slight variations in wall thickness of the end panel of the finished can, or slight variations in the vertical stroke of the mandrel 118. A separate die member 132 is supported for vertical sliding movement along panel die 128, and normally urged in the downward direction by resilient spring means 134 to engage the bottom panel of the deep drawn can in the chime area slightly ahead of engagement by the panel dies 126, 128. Also, the timing of the vertical movement of the respective parts is such that deep drawing of the can body is completed and annular die member 106 commences its upward movement while mandrel 118 is still moving up so that the annular flange 116 on the drawn cup is not restrained during forming of the bottom panel 14 between die members 126 and 128.

The vertical stroke of mandrel 118 is substantially greater and consequently its rate of movement is greater than that of die 106 so that mandrel 118 is withdrawn from within the formed can body by the time annular die 106 moves above the bottom end of stationary knockout 114. Thus, when the die 106 moves above the bottom of the formed can, the can may be removed and a subsequent cup positioned on the draw sleeve assembly before die 106 and mandrel 118 start their next cycle.

Figure 11:
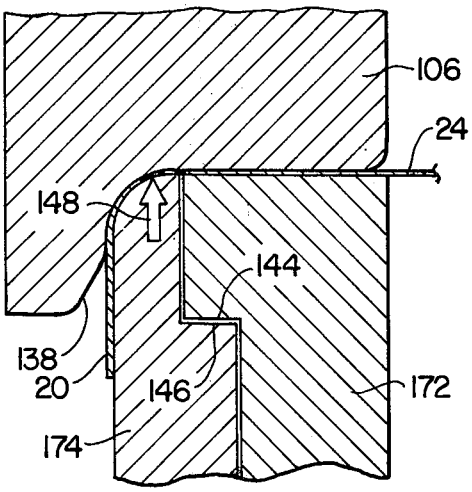
Figure 12:
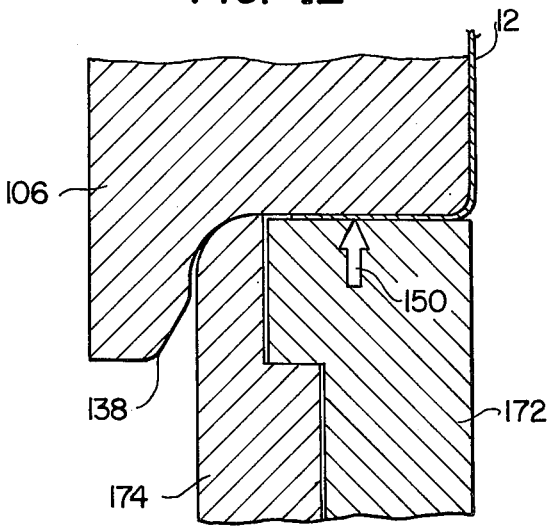

Redraw die 106 has a downwardly directed clamping surface 136 contoured to receive and closely conform to the outer surface of drawn cup 24 around a peripheral band of bottom wall 24 and the transition portion 27 when the cup is positioned over the redraw sleeves 72 and 74. The top clamping surface 90 of outer redraw sleeve 74 and the transition portion of cup 22 are substantially arcuate, and the radial thickness of redraw sleeve 74, in the area contacting the cup 22, is preferably such that the radial center of arcuate surface 90 falls at or near the inner periphery of sleeve 74. This configuration is most clearly seen from FIGS. 10–12 schematically illustrating an alternate embodiment of the invention. As also seen in these figures, redraw die 106 is preferably contoured to accommodate a slight increase in thickness of the cylindrical wall 26 of cup 22 which can occur during the initial drawing or cupping operation, it being understood that such increase in thickness is exaggerated in these figures for illustration purposes.

Figure 5:
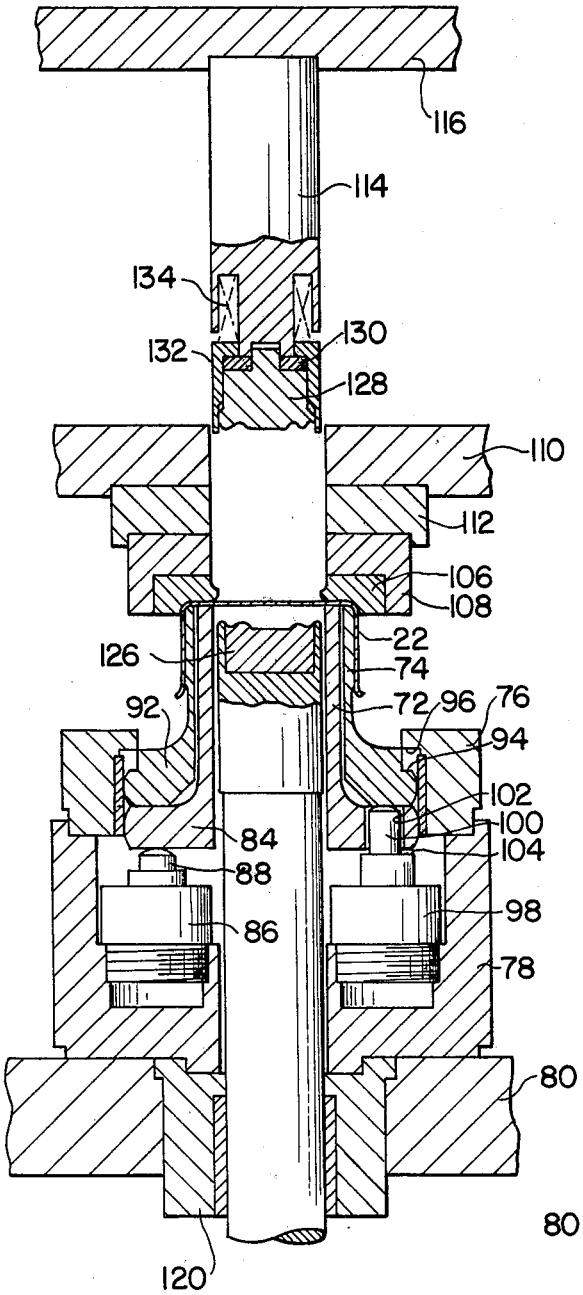
FIG. 5 is a schematic view, similar to FIGS. 3 and 4 and showing an improved redraw apparatus in accordance with the present invention with a drawn cup in position to be redrawn.
Figure 6:
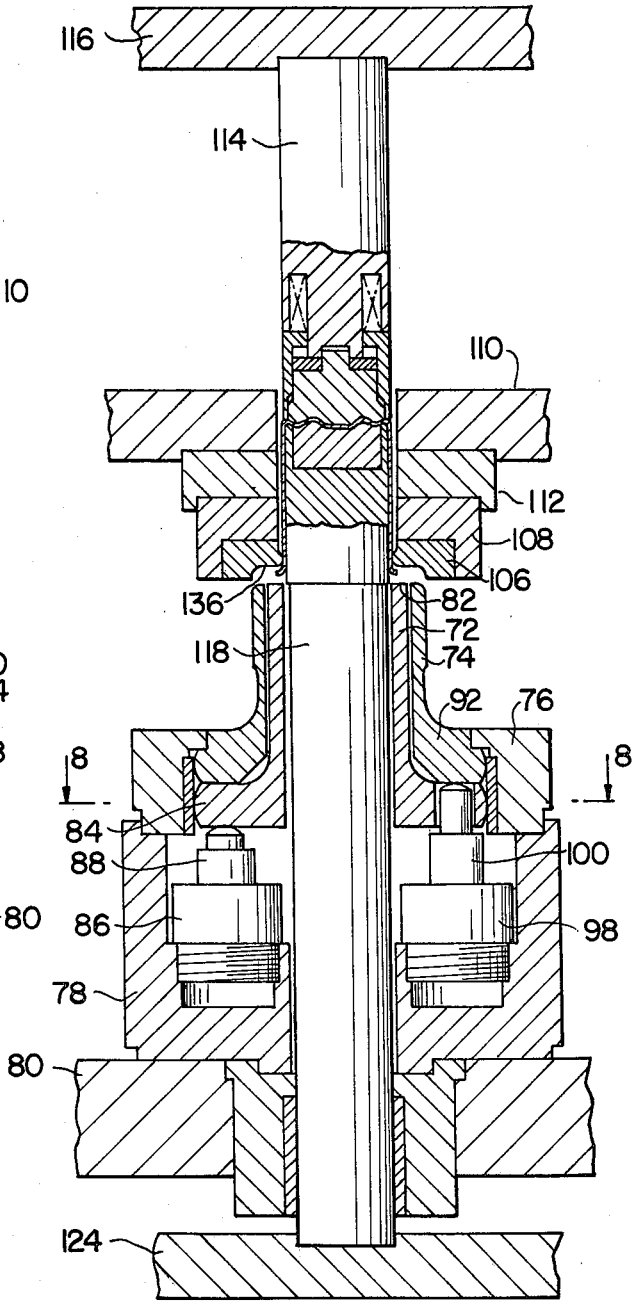
FIG. 6 is a view similar to FIG. 5 and showing the apparatus in a later portion of the redrawing cycle.

In operation of the redraw apparatus of FIGS. 5–7, a drawn cup 22 is positioned over the redraw sleeve assembly and annular die 106 is moved downward to firmly engage and clamp the peripheral edge portion and transition portion of the bottom wall of the cup as illustrated in FIGS. 5 and 10. A tapered guide surface on the downwardly directed lip of die 106 assures proper seating of the cup in the die so that, upon further downward movement, pistons 88 and 100 will be depressed and the cup clamped by the force determined by the fluid pressure within cylinders 86 and 98. At this point mandrel 118 moving upward through the center of inner redraw sleeve 72 engages bottom panel 24 and draws the cup over redraw surface 140 through die 106. During this redrawing of the cup, the metal in the transition portion and the bottom wall portion outboard of surface 140 is positively clamped with a substantially uniform load despite any slight increase in thickness which may have occurred in drawing the cup particularly near the open top end portion of the cup.

When the portion of the cup originally defining the outwardly directed narrow flange 28 is drawn from beneath clamping surface 90, outer redraw sleeve 74 will move upward until the shoulder 104 on pistons 100 engage the bottom surface of flange 84 on sleeve 72, thereby transferring the load from pistons 98 to the inner redraw sleeve and maintaining a substantially constant clamping load throughout the drawing operation. The redrawing operation is preferably terminated leaving the narrow outwardly directed flange 16 extending between the clamping surface 136 of redraw die 106 and the top clamping surface 82 of inner redraw sleeve 72. This flange 16 is subsequently employed in attaching a closure panel in a roll formed seam to close the can.

An alternate embodiment of the invention is illustrated in FIGS. 10–12 wherein the shoulders 104 on pistons 100 may be eliminated. In this embodiment, inner and outer redraw sleeves 172, 174 are substantially identical to redraw sleeves 72 and 74, respectively, except that inner sleeve 172 is formed with a radially extending flange defining a shoulder 144 on its outer surface in axially spaced relation to its end clamping surface, and a recess formed in the inner periphery of outer sleeve 174 at its end defined a radial shoulder 146. The distance from the end clamping surface of inner sleeve 172 to shoulder 144 is less than the distance from the end of outer sleeve 174 to shoulder 146, with this difference in distance being no greater and preferably slightly less than the minimum thickness of the metal to be redrawn on the apparatus. Thus, when the metal is drawn from beneath the clamping surface of outer sleeve 174, this sleeve is free to move upward in the direction of arrow 148 in FIG. 11 until shoulder 146 engages and rests upon shoulder 144, at which point the cylinders 98 will transfer their load through outer sleeve 174 to inner sleeve 172 as indicated by the arrow 150. Thus, the function of the shoulders 104 on pistons 100 is performed by the cooperating shoulders 144, 146 in this embodiment.

Prior to clamping a cup 22, the top portion of the arcuate clamping surface of outer redraw sleeve 174 projects slightly above the flat clamping surface on sleeve 172. This results in the cup being firmly seated in the redraw die ring in the transition section prior to the bottom wall being clamped. This sequential clamping is preferred over the substantially simultaneous clamping by both redraw sleeves of the embodiment shown in FIGS. 5–7, particularly for redrawing relatively hard, high strength steel sheet material.

A comparison of the prior art structure illustrated in FIG. 9 with the structure shown in FIGS. 10–12 clearly illustrates the advantages of the present invention. Thus, in the prior art apparatus, the drawn cup is positioned on a one-piece redraw sleeve 142 and clamped by redraw die ring 106. Again, the thickened condition of sidewall 26 is exaggerated both in FIGS. 9 and 10 to illustrate what happens as the sidewall is drawn between the opposed clamping surfaces. Thus, as any thickened portion centers the clamping area at its outer periphery, the two clamping surfaces will be separated slightly so that the inherent circumferentially compressive stresses can cause wrinkling adjacent the inner periphery of the redraw die 106 in the prior art apparatus. This condition is amplified in the transition portion since the opposed clamping surfaces in this area must be contoured to accommodate the maximum range of thickness variations and since an increase in thickness in the metal being drawn through this area can produce a magnified separation of the parallel clamping surfaces. Also, separation of the parallel clamping surfaces inherently results in a concentration of the entire clamping load in the area of contact, i.e., around the transition portion. Such concentration of clamping load can adversely affect surface characteristics of the drawn cup and materially affect drawing load or even result in failure of the metal being drawn.

By contrast, in accordance with the present invention, the clamping load is applied separately in the transition area and in the area of the opposed parallel clamping surfaces. This inherently limits the maximum load which may be applied in the transition area while at the same time assuring that a substantially uniform load will be applied through the inner redraw sleeve in the clamping area inward of the transition section. When the free edge of the drawn cup passes beneath the arcuate clamping area 90 of the external redraw sleeve, the clamping load previously applied through this outer sleeve is transferred to the inner sleeve and substantially constant clamping load is therefore maintained throughout the drawing operation.

Figure 13:
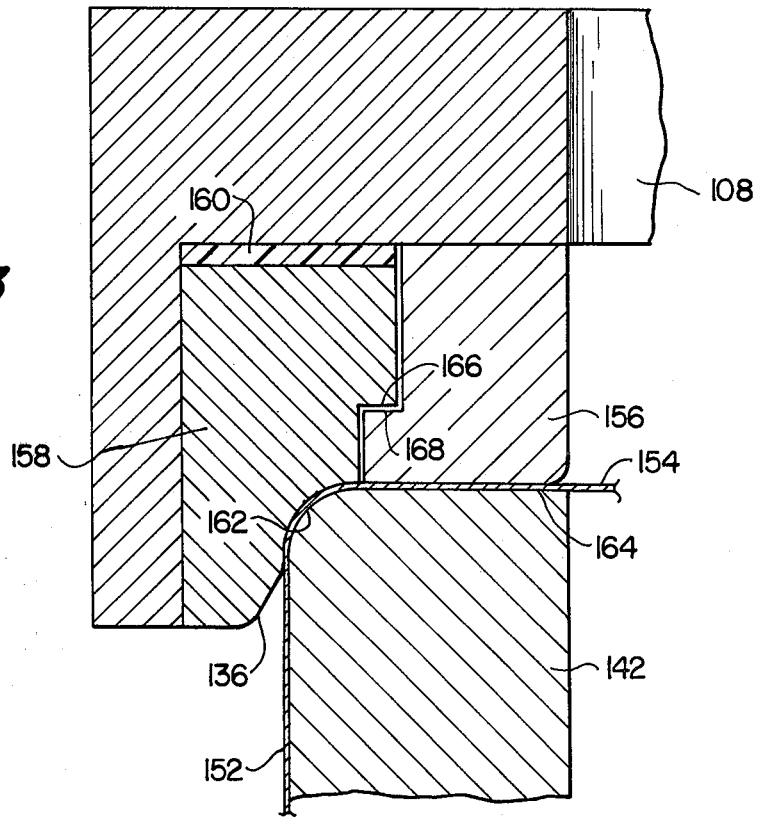
FIG. 13 is a view similar to FIG. 10 and showing a further embodiment of the invention.

FIG. 13 illustrates a further modification of the invention which is particularly useful in redrawing a cup which has been subjected to a wall ironing subsequent to the initial cupping step described above and prior to the final redraw step. Such a wall ironing step results in the sidewall 152 of the drawn and ironed cup being reduced, normally to a thickness substantially less than that of the bottom wall 154 of the finished container. Thus, as drawing commences, metal of a reduced thickness is drawn between the clamping surfaces. In the prior art apparatus illustrated in FIG. 9, this would result in a reduction in the clamping force in the radially outer areas. While the apparatus described above with respect to FIGS. 4–7 can be employed to redraw a wall-ironed cup, it has been found that better results are achieved by employing a single piece redraw sleeve such as the sleeve 142 employed in the prior art, and by forming the redraw die in two concentric rings including an inner die ring 156 having a substantially planar end clamping surface and an outer die ring 158 having a substantially arcuate transition portion clamping area. In this embodiment, interlocking shoulders such as those illustrated in FIG. 12 are preferably employed between die rings 156 and 158, with a resilient biasing means 160 between outer die ring 158 and the support ring 108. The contoured clamping surface 162 of outer die ring 158 projects below clamping surface 164 of ring 156 so that the transition portion of the cup is engaged and clamped first upon lowering the redraw die ring assembly as described above. Further lowering the die ring assembly will result in resilient pad 160 being compressed until the clamping surface 164 engages the flat bottom wall 154 of the cup 10. As in the embodiment of FIGS. 5–7 and 10–12, when the metal being drawn passes through clamping surface 162, outer die ring will be projected down by resilient means 160 until radial shoulder 166 on ring 158 engages shoulder 168 on ring 156. Thereafter, all clamping load will be applied through clamping surface 164. Again, the center of curvature of the substantially arcuate clamping surface on outer die ring 158 is preferably located on or near the extended inner surface of this outer die ring.

While the invention has been described with reference to a redraw sleeve constructed in two concentric ring elements, it should be apparent that more than two such elements can be employed and three or more concentric elements may be employed particularly for redrawing of relatively large diameter can bodies. Thus, while preferred embodiments of the invention have been disclosed and described, it should be understood that the invention is not so limited but rather it is intended to include all embodiments thereof which would be apparent to one skilled in the art and which come within the spirit and scope of the invention.

What is claimed is:

1. Apparatus for forming a deep drawn metal container body by redrawing a drawn cup having an open top, a substantially flat bottom wall, a substantially cylindrical sidewall, and a curved transition section joining the sidewall and bottom wall, the apparatus comprising, annular redraw sleeve means having a free end adapted to fit within and support a drawn cup, said free end having a first annular clamping surface thereon contoured and arranged to engage the inner surface of the transition section and the adjacent annular peripheral portion of the bottom wall of a drawn cup supported on the redraw sleeve means, annular redraw die means having a second annular clamping surface thereon in axially aligned opposed relation to said first clamping surface, said second clamping surface being contoured and arranged to engage the outer surface of said transition section and the adjacent annular peripheral portion of the bottom wall of a drawn cup supported on said redraw sleeve means, one of said annular clamping surfaces being defined by an annular clamping surface portion on each of at least two concentric ring members with the annular clamping surface portion on the outer said ring member being contoured to engage and clamp the curved transition section of a cup, means for moving said annular redraw sleeve means and said annular redraw die means relative to one another to clamp the transition section and the adjacent bottom wall portion of a cup supported on said redraw sleeve means, and male die means movable relative to said annular redraw die means and said annular redraw sleeve means to progressively draw a clamped cup from between said first and second clamping surfaced through said redraw die means to redraw the cup into a deep drawn container body.

2. The apparatus defined in claim 1 further comprising means supporting said concentric ring members for limited axial movement relative to one another, and means separately urging each said ring member for movement in a direction to apply a clamping load to a cup supported on the redraw sleeve means.

3. The apparatus defined in claim 2 wherein the transition section of the cup to be redrawn is substantially arcuate in longitudinal cross section, and wherein the clamping surface of said outer ring member is substantially arcuate in longitudinal cross section.

4. The apparatus defined in claim 3 wherein the clamping surface on each said ring member other than said outer ring member is substantially planar.

5. The apparatus defined in claim 4 wherein the center of curvature of the substantially arcuate clamping surface portion on said outer ring member lies substantially on but not outboard of the line separating the our and next adjacent inner ring element.

6. The apparatus defined in claim 2 wherein said means separately urging said ring members for movement includes means moving the outer said ring member relative to the inner ring members and toward the other said clamping surface when the clamped metal of a cup is drawn radially inward past the outer ring member.

7. The apparatus defined in claim 2 wherein said means separately urging said ring members for movement, comprises at least one gas actuated cylinder having a movable piston engaging and normally resiliently urging each said ring member for axial movement toward the other said clamping surface, and further comprising cooperating stop means on each pair of adjacent concentric ring members limiting such axial movement toward the other said clamping surface of the outer ring member relative to the inner ring member of each such concentric pair of ring members.

8. The apparatus defined in claim 1 wherein said redraw sleeve means comprises inner and outer concentric generally cylindrical sleeve members each having one end defining one of said clamping surface portions, said outer sleeve member having an external diameter substantially equal to the internal diameter of a cup to be redrawn and being adapted to be telescoped into and support such cup.

9. The apparatus defined in claim 8 further comprising means mounting said inner and outer sleeve members for limited axial movement relative to one another, and means separately urging said inner and outer sleeve members toward said redraw die to apply a predetermined clamping force to a cup clamped between said first and second clamping surfaces.

10. The apparatus defined in claim 8 further comprising means for transferring the clamping force applied to the outer sleeve member to said inner sleeve member when the open top portion of a cup clamped between and said first and second clamping surfaces is drawn inward past the clamping surface portion on the outer sleeve member to thereby maintain a substantially constant clamping load on the clamped portion of the cup throughout the redrawing operation.

11. The apparatus defined in claim 10 wherein said means for transferring the clamping force from the outer to the inner sleeve member comprises stop means on said inner sleeve member in position to engage said outer sleeve member to limit axial movement of said outer sleeve member toward said redraw die means and relative to said inner sleeve member to a distance not greater than the minimum thickness of the metal to be clamped.

12. The apparatus defined in claim 8 further comprising rigid frame means supporting said redraw sleeve means, and wherein said redraw sleeve means includes housing means mounting said sleeve members for axial movement toward and away from said redraw die means, stop means limiting movement of said sleeve members toward said redraw die means, and resilient means normally urging each said sleeve member toward said redraw die means.

13. The apparatus defined in claim 12 wherein said means for moving said redraw sleeve means and said redraw die means relative to one another comprises means for moving said redraw die means between a retracted position spaced from said redraw sleeve means and a clamping position engaging and clamping a cup supported on said redraw sleeve means and moving said sleeve members in a direction away from said redraw die means against the force of said resilient means.

14. The apparatus defined in claim 13 wherein said resilient means comprises gas actuated cylinder means including piston means normally resiliently urging each said sleeve member toward said redraw die means to maintain a clamping force applied to a cup clamped between said first and second clamping surfaces.

15. The apparatus as defined in claim 1 wherein said redraw die means comprises inner and outer concentric ring members each having one of said clamping surface portions formed thereon.

16. The apparatus defined in claim 15 further comprising means mounting said inner and outer ring members for limited axial movement relative to one another, and means for moving said redraw die means toward said redraw sleeve means to clamp a cup supported on the redraw sleeve means and to move the redraw die means away from said redraw sleeve means to permit a redrawn container to be removed from the apparatus and a second cup to be positioned on the redraw sleeve means.

17. The apparatus defined in claim 16 further comprising means resiliently urging said outer ring member toward said redraw sleeve means, and stop means limiting axial movement of said outer ring member relative to said inner ring member.

18. The apparatus defined in claim 17 further comprising means mounting said redraw sleeve means for limited movement toward and away from said redraw die means, and resilient means normally urging said redraw sleeve means toward said redraw die means to maintain a clamping load on a cup clamped between said redraw die means and said redraw sleeve means.

19. An improved method of forming a flat sheet metal blank into a container body by a deep drawing operation comprising, initially drawing the sheet metal blank into a shallow cup having an open top, a substantially flat bottom wall, a substantially cylindrical sidewall, and a curved transition section joining the sidewall and bottom wall, providing a redraw sleeve having a free end, the free and having a first annular clamping surface thereon contoured to engage the curved transition section and an adjacent annular portion of the bottom wall of the inner surface of the drawn cup, positioning a drawn cup on the redraw sleeve with the inner surface of the transition portion and bottom wall in contact with the first clamping surface, providing an annular redraw die having a second annular clamping surface thereon disposed in opposed relation to the first clamping surface and contoured to engage the outer surface of the transition section and the adjacent annular portion of the bottom wall of the cup supported on the redraw sleeve, one of the clamping surfaces being defined by an annular clamping surface portion on each of an outer and at least one inner concentric ring elements supported for limited axial movement relative to one another, clamping a drawn cup supported on the redraw sleeve between the first and second clamping surfaces by producing relative movement between the redraw sleeve and the annular redraw die toward one another, and separately urging each of the concentric ring elements toward the cup bottom wall to apply a clamping load to the cup through the clamping surface portion on each of the ring elements, and engaging and redrawing the drawn cup through the annular redraw die by use of a male die.

20. The method defined in claim 19 further comprising the step of limited relative axial movement between the concentric ring elements to a distance no greater than the minimum thickness of metal in the cup to be redrawn.

21. The method defined in claim 20 further comprising the step of transferring the clamping load applied to the outer clamping ring element to the adjacent inner clamping ring element when the open top portion of the drawn cup is redrawn inwardly past the clamping surface portion on the outer ring element.

22. The method defined in claim 19 wherein the step of producing relative movement between the redraw sleeve and the redraw die comprise moving the redraw die from a retracted position spaced from the redraw sleeve to a clamping position engaging and clamping a cup supported on the redraw sleeve prior to engaging the cup by the male die, and for moving the redraw die from the clamping position to the retracted position after the cup has been withdrawn.

23. The method defined in claim 22 wherein a cup supported on the redraw sleeve is engaged by the clamping surface on the redraw die at a point intermediate the retracted and clamping positions and wherein continued movement of the redraw die to the clamping position produces corresponding movement of the redraw sleeve, the method further comprising yieldingly urging the redraw sleeve toward the redraw die to maintain a clamping load on the cup at the clamping position.

24. The method defined in claim 23 wherein the step of clamping a cup comprises producing relative movement between the redraw sleeve and the redraw die to initially clamp the transition portion of the cup between the clamping surface portion on the outer ring member and the opposed clamping surface, and subsequently clamping the adjacent annular portion of the cup bottom wall between the clamping surface portion on the inner clamping ring and the opposed clamping surface.

25. The method defined in claim 24 further comprising the step of transferring the clamping load applied to the outer clamping ring element to the adjacent inner clamping ring element when the open top portion of the drawn cup is redrawn inwardly past the clamping surface portion on the outer ring element.

26. The method defined in claim 23 wherein the redraw sleeve comprises outer and inner concentric generally cylindrical ring elements, and wherein the step of clamping a cup further comprises yieldingly urging the outer and inner ring elements toward the redraw die, and limiting movement of the ring elements toward the redraw die.

27. The method defined in claim 26 further comprising the step of limiting relative axial movement between the concentric ring elements to a distance no greater than the minimum thickness of metal in the cup to be redrawn.

28. The method defined in claim 27 further comprising the step of transferring the clamping load applied to the outer clamping ring element to the adjacent inner clamping ring element when the open top portion of the drawn cup is redrawn inwardly past the clamping surface portion on the outer ring element.

* * * * *